US005492721A

United States Patent [19]

Berthold et al.

[11] Patent Number: 5,492,721

[45] Date of Patent: Feb. 20, 1996

[54] METHOD FOR PRODUCING ENAMELLED WIRES USING FUSIBLE RESINS

[75] Inventors: Herbert Berthold, Deutschlandsberg; Hans-Peter Pichler, Graz, both of Austria

[73] Assignee: MAG Maschinen und Apparatebau Gesellschaft mbH, Graz, Austria

[21] Appl. No.: 74,053

[22] Filed: Jun. 8, 1993

Related U.S. Application Data

[60] Continuation of Ser. No. 796,792, Nov. 25, 1991, abandoned, which is a division of Ser. No. 675,595, Mar. 27, 1991, abandoned.

[30] Foreign Application Priority Data

Mar. 30, 1990 [DE] Germany ..... 40 10 306.4

[51] Int. Cl.[6] ..... B05D 3/12

[52] U.S. Cl. ..... 427/178; 427/318; 427/358; 427/434.7

[58] Field of Search ..... 427/434.2, 434.6, 427/434.7, 435, 318, 178, 175, 117, 358; 118/420, 405; 72/46

[56] References Cited

U.S. PATENT DOCUMENTS

| | | | |
|---|---|---|---|
| 1,945,851 | 2/1934 | Freeland | 118/DIG. 19 |
| 2,393,678 | 1/1946 | Graham | 118/DIG. 18 |
| 2,394,066 | 2/1946 | Kauth | 118/DIG. 19 |
| 2,445,675 | 7/1948 | Lang | 118/DIG. 18 |
| 2,867,891 | 1/1959 | Horton et al. | 427/434.6 |
| 3,471,327 | 10/1969 | Gerland et al. | 427/318 |
| 3,533,761 | 10/1970 | Pierson | 427/434.6 |
| 3,615,709 | 10/1971 | Grasshoff et al. | 427/318 |
| 3,808,034 | 4/1974 | Schreiner et al. | 118/420 |
| 3,877,966 | 4/1975 | Goyffon | 427/318 |
| 3,920,864 | 11/1975 | Greenberg et al. | 427/343 |
| 4,195,105 | 3/1980 | Mares et al. | 427/386 |
| 4,217,852 | 8/1980 | Nagai et al. | 118/405 |
| 4,365,790 | 12/1982 | Horvath et al. | 118/65 |
| 4,391,848 | 7/1983 | Hilker | 427/435 |
| 4,521,173 | 6/1985 | Hilker et al. | 118/405 |
| 4,765,271 | 8/1988 | Jochem et al. | 118/405 |
| 5,151,306 | 9/1992 | Andrews et al. | 118/420 |

FOREIGN PATENT DOCUMENTS 58-55534 4/1983 Japan .

*Primary Examiner*—Terry J. Owens
*Assistant Examiner*—Katherine A. Bareford
*Attorney, Agent, or Firm*—Dennis T. Griggs

[57] ABSTRACT

Enamelled wire is produced using almost solvent-free fusible resins. Molten resin is pumped from a supply reservoir against the direction of movement of the wire with part of the resin coating the wire. The raw wire is preheated to a temperature near the melting temperature of the molten resin. Excess resin is returned to the supply reservoir after the resin coating the wire has been calibrated to a predetermined circumferential dimension. The resin coating the wire is then hardened. The coating apparatus includes a raw wire guide, a demineralized water bath, an annealing furnace having a protective steam atmostphere, a cooling water bath, a wire preheater, an enameling stove, a heated resin reservoir, a resin applicator and a winding-on machine. The resin coating is applied under closed system conditions, thereby substantially reducing emissions.

4 Claims, 5 Drawing Sheets

METHOD FOR PRODUCING ENAMELLED WIRES USING FUSIBLE RESINS

CROSS REFERENCE TO RELATED APPLICATIONS

This is a continuation of application Ser. No. 07/796,792, filed Nov. 25, 1991, abandoned, which is a division of application Ser. No. 07/675,595, filed Mar. 27, 1991, abandoned.

Priority benefits under Title 35, §119 of the United States Code are claimed with respect to:

Application No. P 40 10 306.4

Federal Republic of Germany

Filed: 30 Mar. 1990

BACKGROUND OF THE INVENTION

The invention relates to a method for producing enamelled wires using almost solvent-free fusible resins, with the wire being pulled off a raw wire guide, coated and re-wound by a winding-on machine, and an apparatus comprising a raw wire guide, a coating means for solvent-free resins, and a winding-on machine for producing enamelled wires using solvent-free fusible resins.

The term enamelled wire relates to enamel-insulated wires which are classified according to their shapes into round and flattened wires and according to the material into copper and aluminum wires. Enamelled wire serves to allow for a good insulation of an electric conductor with respect to a neighboring conductor or the carrier of windings. The main advantage of this type of insulation with regard to others is that the wall thickness of the coat of enamel is extremely small. In the case of a copper wire having a diameter of 0.4 mm, for example, the coat thickness is only 16 μm.

Enamelled wires are above all used for producing electrical windings serving for current conduction, voltage transformation, field set-up and field deflection.

The desired thickness of the coat of enamel is obtained by several applications of enamel and it can consist of materially uniform coatings or two or three materially different coatings. Examples of enamels used in the prior art are polyurethane (PUR) for use in small-size motors, transformers, relays, magnet coils and so on, two-coat enamels by use of which the mechanical, thermal and chemical qualities can be improved, nylon coatings which are very even as well as baking enamels which can be used for glueing windings together to form one unit by way of hot air or by heating them with a surge of current.

DESCRIPTION OF THE PRIOR ART

Enamelling systems are usually classified into conventional systems and systems having a combined in-line drawing machine. Due to a series of advantages essentially consisting in the increased softness of the copper and the higher quality with the same drawing and enamelling apparatus, enamelling systems having in-line drawing machines are becoming more and more important. Such a system for producing enamelled wire making use of the in-line technique is known from the DE-PS 3 118 830, for example.

The enamels which are known from and used in the prior art are basically composed of film-forming resins and solvents. The solvent allows for the coating being applied in liquid form and its composition influences the eveness of the coating film. Solvents used for wire enamels are basically mixtures of cresol, xylenol and solvent naphthan and make up about ⅔ of the enamel volume.

The disadvantages of the solvent consist in the dangerous properties thereof. The liquid is usually poisonous and caustic and forms explosive mixtures upon heating, said mixtures furthermore being heavier than air. If operators breath in the fumes, they show signs of poisoning. Skin and eye damage by penetration of the skin and even paralysis of the central nervous system involving secondary injuries have been reported.

A method and an apparatus for coating wires are known from the EP-PS 0 063 963, in which a resin with a solvent percentage of only 5% is used. The special disadvantage of the characterized method and the described apparatus is that applying the resin takes place in an open system, so that the solvents need to be disposed. And apart from that, the only combinations of enamel used in the apparatus according to that invention are those which can be used in a single-layer process and thus permit a fast passage and consequently a high production rate.

An alternative method requiring almost no solvents is the use of so-called fusible resins (hot melts). The fusible resin must be brought to a predetermined temperature in order to obtain a workable viscosity for the application. This step requires an accurate control of the temperature and the layers obtained are thicker than with conventional enamels, so that for obtaining the desired layer thicknesses fewer layers of fusible resin must be applied in correspondingly fewer steps.

SUMMARY OF THE INVENTION

Thus the object of the invention is to provide for a method and an apparatus for producing an enamelled wire exhibiting a high resistance to heat using fusible resins, with the enamelled wire coming up to the quality tests of the international standards, for allowing for a more economical production of enamelled wire compared with conventional methods and apparatuses, for keeping with even the strictest regulations on environmental protection, and for guaranteeing a field of application which is as broad as possible.

With regard to environmental protection the special advantage of the invention lies on the one hand in the resins used containing almost no solvents and on the other hand in said resin being transported in a closed system during coating, so that, apart from the layer on the wire, virtually no emission takes place.

Immediately after coating the wire is subjected to a drying and baking process, so that the total emission is extremely low. Experiments have shown that a catalytic converter in the exhaust system can be dispensed with altogether as the total emission is far below the admissible values.

Seen from an economical point of view, the fact that excess resin which has been peeled off can be led back to the supply and thus be used for further coatings is another special advantage.

BRIEF DESCRIPTION OF THE DRAWINGS

Further advantages and features of the invention can be taken from the following description with the aid of the drawings.

In these drawings.

DETAILED ACCOUNT OF WORKING EXAMPLE OF THE INVENTION

Figure 1:
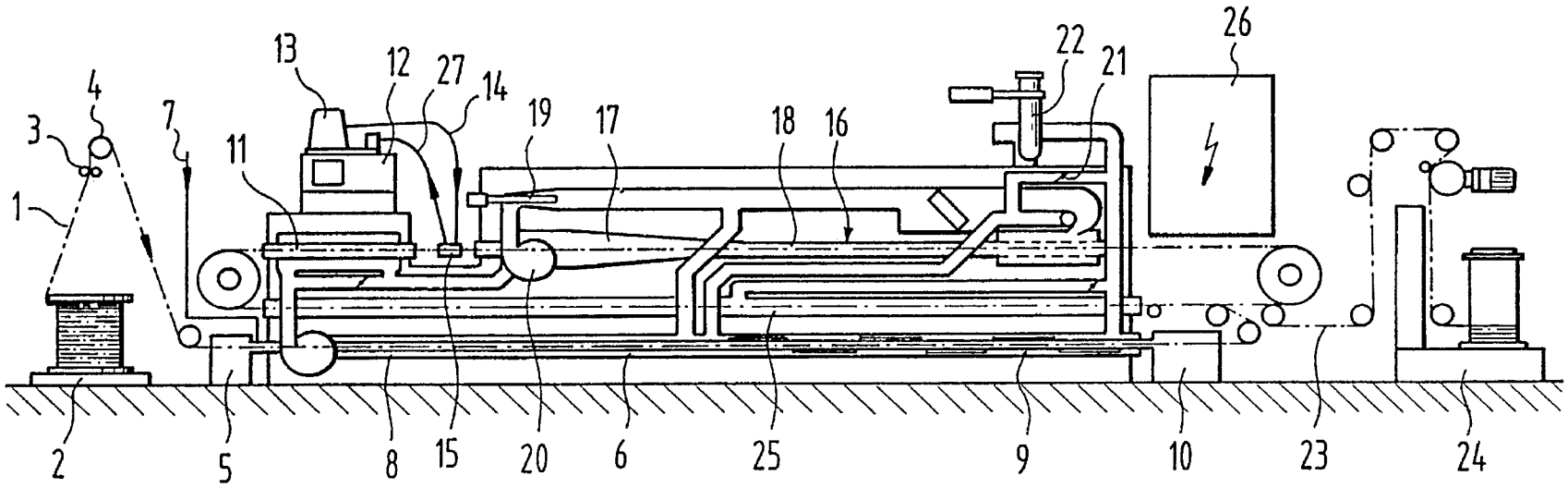
FIG. 1 shows an embodiment for an apparatus according to the invention for producing enamelled wires using fusible resins.

The raw wire 1 is pulled off a stationary raw wire coil 2 in an upward direction. A wire brake 3 consisting of two brake rollers and an adjusting screw allows for proper tension of the wire and prevents it from sagging. A wire guide 4 is arranged above the wire brake.

Prior to entering the annealing furnace 6 the raw wire is cleaned in a demineralized water bath 5.

The raw wire 1 exhibiting a certain drawing hardness passes through an annealing furnace 6 in which it is recrystallized, i.e. brought into the desired soft state in which it can be bent. The steam 7 therein prevents as protective gas atmosphere the wire surface from oxidizing. By means of the temperatures prevailing in the annealing furnace 6 and the steam 7 continuously led in, further residual impurities from the drawing process are removed.

The annealing furnace 6 is provided with a first .annealing zone 8 and a second annealing zone 9 in which various methods, such as circulating-air, exhaust-air or electric heating systems, are made use of.

Immediately after its having been annealed, the hot wire is cooled in a water bath 10 to prevent it from tarnishing. The cooling water remaining on the wire is removed by way of a blow-off means.

The application temperature required for fusible wires lies within 140° C. and 180° C. The wire 1 is preheated for preventing the resin from being cooled down by the wire. The annealing furnace 6 as well as a wire preheating means 11 are heated via a secondary circulating-air circuit by an enamelling stove 16 and controlled with the aid of a fan or an adjusting flap. After the wire 1 has been annealed, it is led back via a blind retort 25. The solid resin is molten in a coated aluminum reservoir having heating elements cast en bloc. A gear pump transports the hot resin with excess pressure first through a filter 13 and then through a heated supply pipe 14 into the coating means 15. The excess resin is led back via the return pipe 27 to the resin reservoir.

The entire resin preparation and resin application means is a closed system.

The hot resin is conveyed with excess pressure from the resin preparation means 12 into the application means 15 and through hard-metal nozzles. The surplus .resin is transported through the return pipe back into the resin preparation means 12. The resin application means 15 is provided with a controllable heating element for keeping the molten resin within a range of viscosity of 300–1000 mPas suitable for working. The wire 1 passes four times through said means (in special cases up to six times), i.e. four hard-metal nozzles having passages of different cross sections are provided for in said means.

In the enamelling stove 16 the wire 1 first passes through the drying zone 17, then through the enamelling zone 18. In the enamelling zone 18 the solid body content of the resin is converted into a highly molecular, chemically and thermically resistant state. The hot-melt enamelling stove 16 works according to the circulating air system. As contrary to the conventional enamelling systems no combustion energy from the solvents is produced, a gas burner 19 or alternatively an electric radiator is integrated in the circulating-air circuit. The amount of circulating air is regulated by the rotary speed of the circulating-air fan 20.

Regulating the temperature is possible via a flap 21 by controlling the resistance of the circulating air, said resistance being lowest when the flap 21 is open. The wire then arrives at a winding-on machine 24.

The finished enamelled wire 23 is pulled over a pull-off disc and reeled.

The enamelling stove 16 furthermore comprises a controllable exhaust gas fan 22 blowing the waste air to the outside.

In order to guarantee a perfect functioning of the wire enamelling system, measuring and control units are necessary, said units measuring and controlling important quantities within given limits. The control box 26 comprises the entire control of the wire enamelling apparatus as well as the display units for temperatures, fan speed, control lamps, and so on.

The most important quantities to be measured are, apart from consumption quantities such as the consumption of gas, current, and resin, the rotary speed of a secondary circulating-air fan, the main circulating-air fan 20, and exhaust gas fan 22, the position of the exhaust gas flap 21 and a high-frequency measuring instrument, above all temperatures. The temperatures are measured in the area of the annealing zone 1, the annealing zone 2, the blind retort, the wire preheating means, the resin utensils, the drying zone as well as of the enamelling zone, the room temperature, the temperature in front of the gas burner, the temperatures of the heat exchanger admissions and exits in the area of the wire preheating means, the temperature of the resin reservoir, of the return and supply pipe of the reservoir, a reservoir return pipe top as well as the temperatures of the various deflection rollers. Various deflection rollers are shown in FIG. 1 but without designations.

Experiments have shown that several quantities measured have considerable effects on the quality of the finished enamelled wire. Among them is the temperature of the annealing furnace, which is decisive for the softness of the copper wire and controlled by measuring the bending force and the yield strength-of finished enamelled wire specimens. If the annealing temperature is too high, small pointed copper bars called bristles can prick up and result in an increase in the high-voltage fault number.

Another important influence quantity is the temperature of the resin reservoir which has to be selected to be such that the resin attains a viscosity favourable for being conveyed via pumps to the application utensils. If the temperatures, however, are too high, the resin ages and again becomes more tenacious. The temperature of the resin supply and return pipes is important in this context, with the main criterium for selection of the temperature in this connection being the range of viscosity favourable for a problem-free conveyance.

Due to the small amounts in the pipes the problem of ageing is only of minor importance.

It must be possible to accurately control the temperature in the resin-coating means 15 in order to keep the molten resin within a range of viscosity of 300–1000 mPas.

An important influence quantity is the temperature and the amount of main circulating air in the enamelling stove. Both factors are quantities having a certain influence on the degree of baking of the resin and thus decisive for the quality of the enamelled wire. Baking temperatures which are too low or too high can result in cracks forming in the insulating layer if the wire is subjected to stress.

The wire speed has an enormous influence on the quality of the finished enamelled wire 23. The characteristic number in this connection is the v·d-value indicating the production capacity of a machine. Therin v is the wire speed in m/min and d the wire diameter in mm. Since a change in speed results in a change of the dwelling time of the wire in the enamelling stove, the temperatures in the individual heating zones, such as the annealing and the enamelling zone, and perhaps other factors also need to be changed in the case of an increase in speed.

Optimal parameters for corresponding enamelled wire/resin combinations can of course be determined through experiments.

The following quantities have proven to be optimal as almost universally valid adjusting quantities:

| | |
|---|---|
| Temperature of annealing stove zone 2 | 460° C. |
| Temperature of resin reservoir | 160° C. |
| Temperature of resin feed and return pipes | 140° C. |
| Exhaust fan speed | 2300 rpm. |

The wire used was an enamelled wire d=1.06 mm, and the coating was type 526 HM resin.

The influence quantities have been proven to optimal in the following combination:

| | |
|---|---|
| Temperature of resin-coating means | 170° C. |
| Temperature of enamelling stove | 530° C. |
| Speed of the circulating-air fan | 3000 rpm |
| Speed of the main circulating-air fan | 3700 rpm |
| Wire speed | 28 m/min. |

Figure 2:
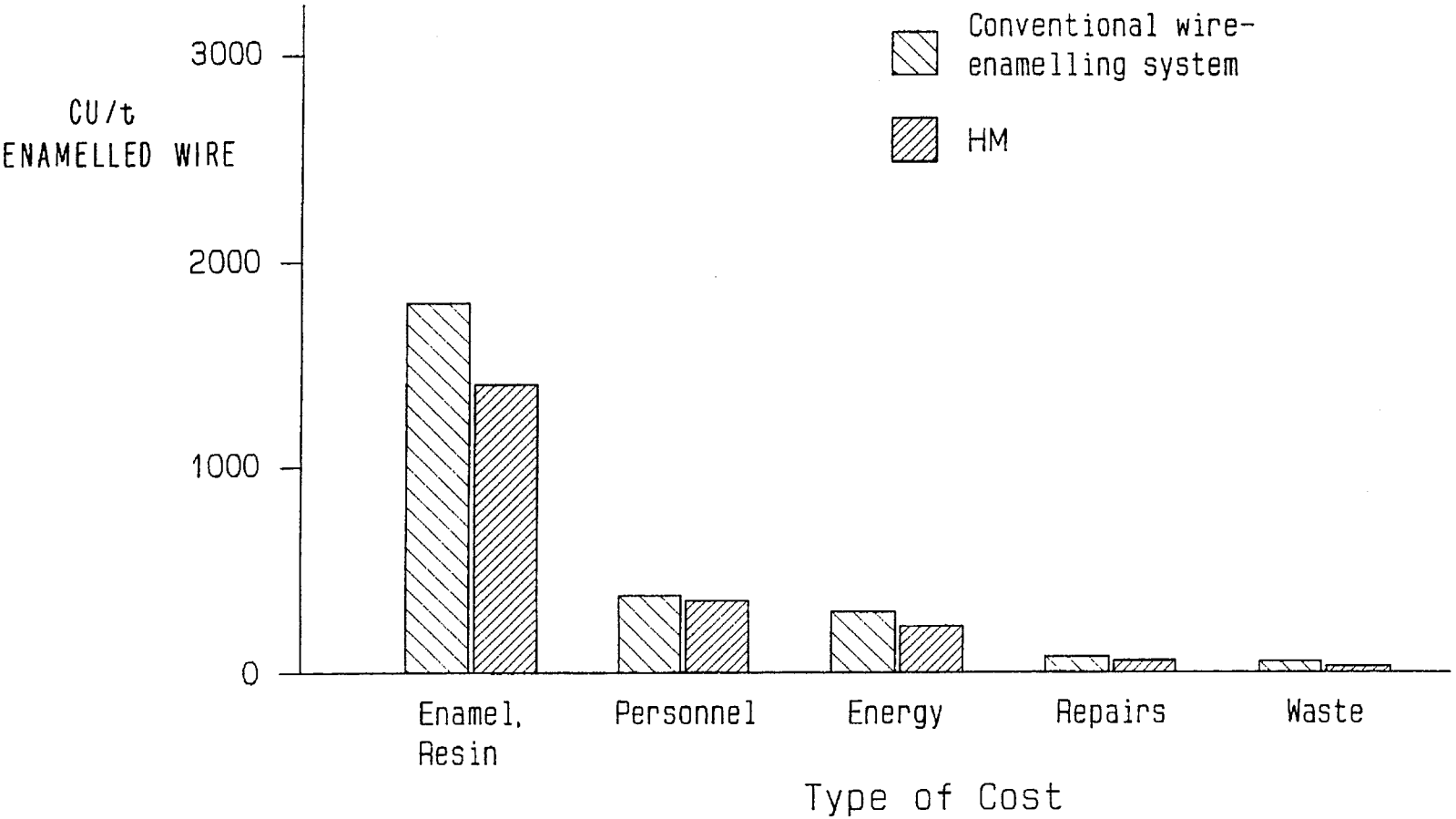
FIG. 2 a diagram with the results of the economical comparison of a conventional enamelling system with the fusible-resin system according to the invention.

In FIG. 2 a survey of the most important types of costs is shown, wherein a conventional enamelling system is compared with the fusible-resin system according to the invention. The types of costs have been allocated in the abscissa and the cost units per ton enamelled wire (CU/t enamelled wire) in the ordinate. The VN6 scientific data of the vertical enamelled wire apparatus, which at the moment represents the industrial standard for wire-enamelling apparatuses, were used as comparative data.

The result of this comparison shows that the apparatus of the invention working according to the hot-melt method comes off better in all types of costs.

The main result is that the method according to the invention and the corresponding apparatus is considerably more economical with regard to the costs than conventional enamelling machines or methods.

Figure 3:
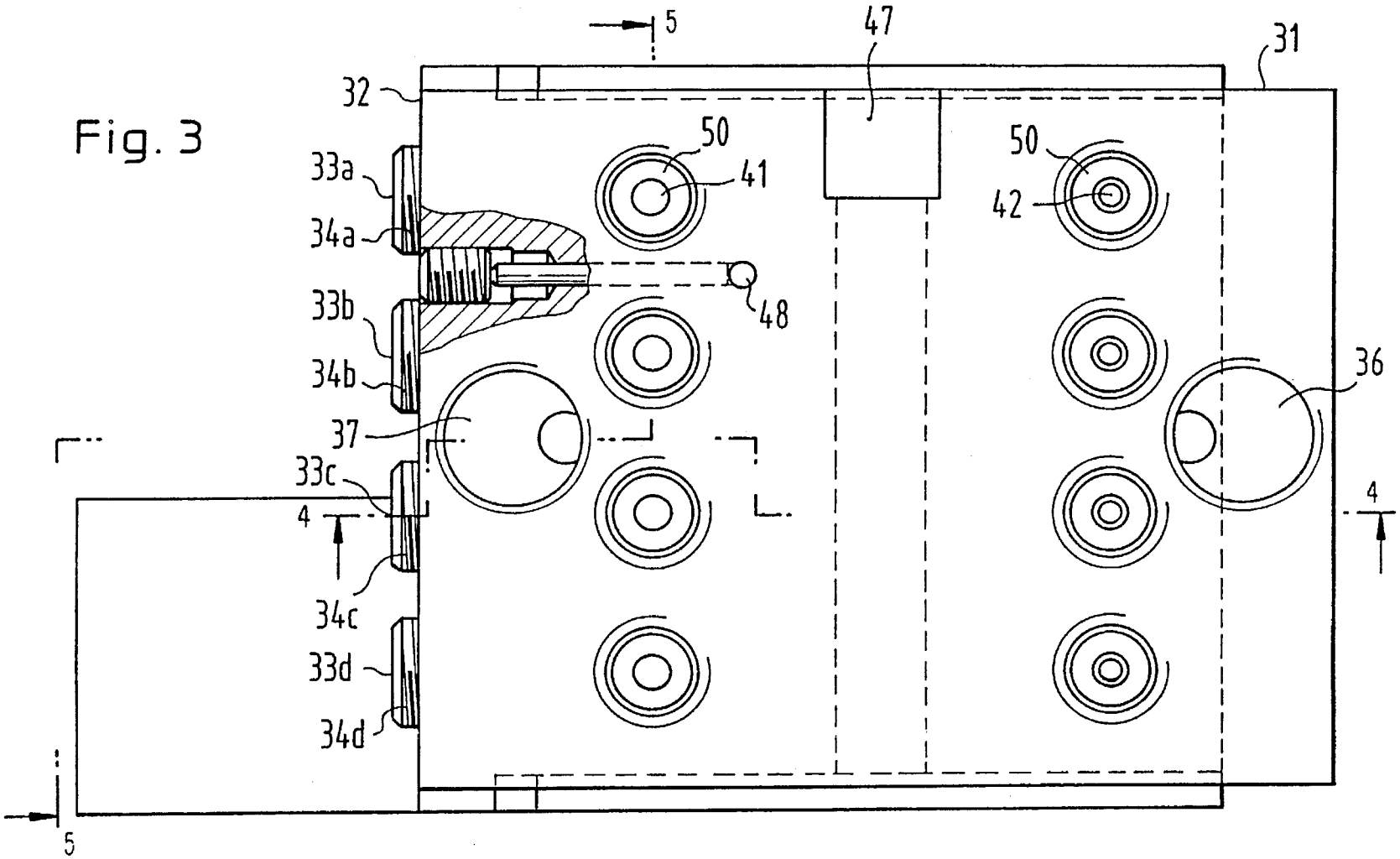
FIG. 3 a partially sectional view of a top view of a resin-coating means according to the invention.
Figure 4:
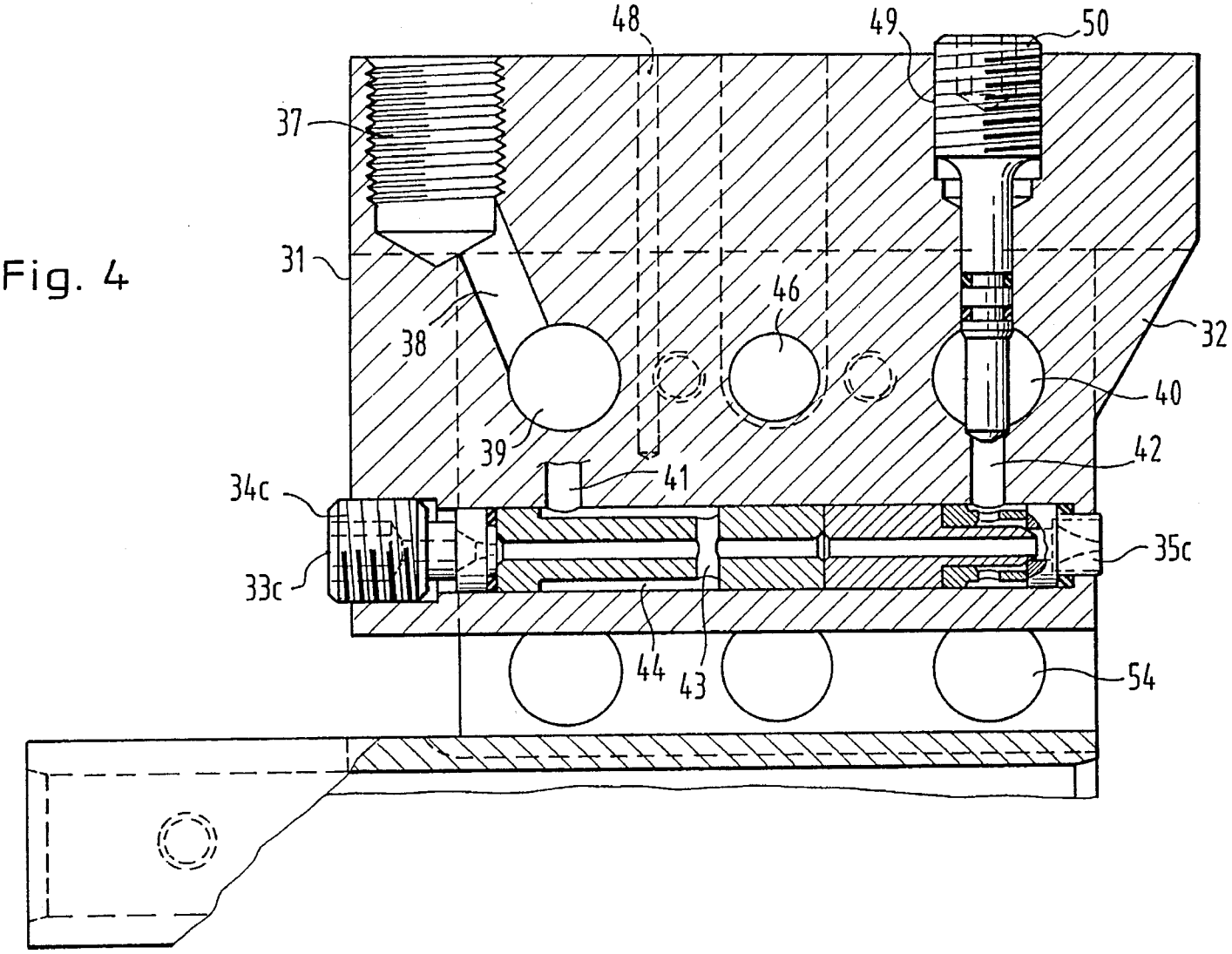
FIG. 4 a sectional view along line 4—4 according to FIG. 3.
Figure 5:
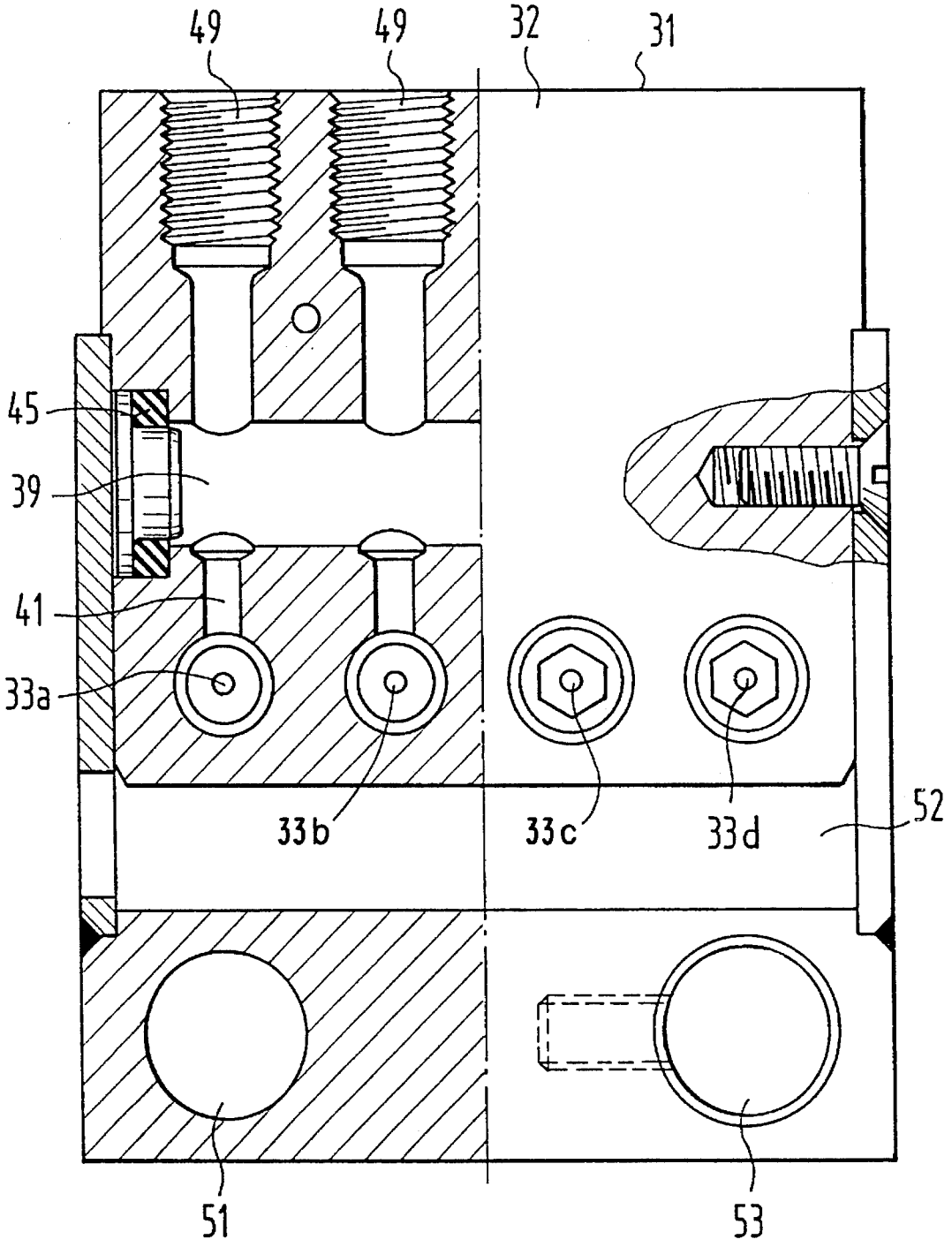
FIG. 5 a sectional view along line 5—5 according to FIG. 3.

In the following an embodiment of a resin-coating means according to the invention is described with the aid of FIGS. 3 to 5.

The resin-coating means 31 comprises a housing 32 through which bolt holes 33*a*, 33*b*, 33*c* and 33*d* lead. These holes 33*a* to 33*d* are the wire-duct holes, so that this is a four-traction resin-coating means. Thus either four wires can be enamelled in a parallel process or one wire can be enamelled four times after having been correspondingly reversed and led back.

Hard-metal sleeves 34*a*, 34*b*, 34*c* and 34*d*, respectively, are arranged at the admissions and exits of these wire ducts. Sealing elements, such as so-called stuffing boxes, are furthermore provided for. Thus the wire duct is sealed at the front and rear side, so that a medium under pressure cannot penetrate at the front and rear side.

Two blind holes 36 and 37 are arranged at the surface, with 36 being the resin inlet and 37 the resin outlet. These threaded holes are connected via a channel 38 .extending diagonally into the inside of the housing 32 with one of the channels 39 or 40, respectively, extending transversly with respect to the wire ducts but above said ducts. By means of these transverse ducts the resin coming in is distributed in transverse direction to an area above the four wire ducts. The channels 39 and 40 are in turn connected with the wire ducts by vertical channels 41, 42.

If a wire runs through the wire duct, for example 33*c*, it passes the front sleeve 34c, passes through the wire duct and passes the back sleeve 35c. Resin penetrates the housing 32 through the resin inlet 36 and is distributed via a diagonal channel which is not shown into the channel 40 extending in transverse direction with respect to the wire ducts. From there the resin is pressed under excess pressure via the channels 42 into the respective wire ducts 33*a* to 33*d* and runs through the wire ducts against the direction of movement of the wire. By means of a hole 43 in the wire duct the excess resin is distributed into an annular necking 44 at the outside of the wire duct. From there the resin is pressed under excess pressure through the channels 41 into the transverse collecting channel 39. From there the resin is transported via the diagonal channel 38 into the resin outlet 37 and thus back to the resin-preparation means.

The ends of transverse channels 39 and 40 are of course also entirely sealed by means of sealing agent 45. A heater 47 is located inside a hole 46 also extending in transverse direction to the wire ducts and essentially parallel with regard to the distribution channels 39 and 40. The heater 47 may be a heat exchanger, or it may be electrically energized. By means of said heater the housing and thus the entire resin-application means are kept at a temperature causing the desired viscosity of the resin which is desireable for the coating of the wire. Thermal elements 48 for measuring the temperature are furthermore provided inside the corresponding holes.

For reasons of production engineering on the one hand and for reasons of cleaning and adjustment on the other hand holes 49 having sealing and adjusting screws 50 are arranged above the vertical connecting channels 41, 42. Further holes 51 to 54 for ventilation, cleaning or other purposes are shown in the Figures.

What is claimed:

1. A method for producing enamelled wire using fusible resins, with the wire being pulled off a raw wire guide through a resin coating means, coated in the resin coating means with molten resin and re-wound by a winding-on machine, comprising the steps:

pumping the molten resin from a supply into the resin coating means at a rate which exceeds a rate needed to produce a coated wire having a calibrated diameter;

pulling the wire through the resin coating means in contact with the molten resin and through a wire-duct hole having a calibrated diameter; and, returning excess resin from the resin coating means to the supply.

2. A method for producing enamelled wire as set forth in claim 1, comprising the steps:

maintaining molten resin in a supply at melting temperature;

circulating the molten resin in contact with said wire as it is pulled through the resin coating means;

calibrating the resin coating the wire to a calibrated diameter; and hardening said resin coating on the wire.

3. A method for producing enamelled wire as set forth in claim 1, including:

preheating a length of the raw wire to be coated;

pumping the molten resin in contact with the raw wire to be coated through a circulation path in the resin coating means as the wire is pulled through the resin coating means; and, calibrating the diameter of the resin coated wire by pulling the coated wire through a wire-duct hole.

4. A method for producing enamelled wires as defined in claim 3, including the step of:

maintaining the molten resin applied to the preheated raw wire within a viscosity range of from about 300 mPas to about 1,000 mPas.

* * * * *